US009056742B2

(12) United States Patent
Schwamberger et al.

(10) Patent No.: US 9,056,742 B2
(45) Date of Patent: Jun. 16, 2015

(54) PROCESS FOR INITIATING A WEB WINDING PROCESS

(75) Inventors: Brian Christopher Schwamberger, Fairfield Township, OH (US); Michael Joseph Lamping, Cincinnati, OH (US); David Stuart Howell, II, Washington Township, OH (US); Mark Levandoski, Kings Mills, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 387 days.

(21) Appl. No.: 13/235,691

(22) Filed: Sep. 19, 2011

(65) Prior Publication Data

US 2013/0068874 A1 Mar. 21, 2013

(51) Int. Cl.

| | |
|---|---|
| ***B65H 23/24*** | (2006.01) |
| ***B65H 19/28*** | (2006.01) |
| ***B65H 26/02*** | (2006.01) |
| ***B65H 19/22*** | (2006.01) |
| *B65H 29/58* | (2006.01) |

(52) U.S. Cl.

CPC ..... *B65H 19/283* (2013.01); *B65H 26/02* (2013.01); *B65H 29/58* (2013.01); *B65H 2406/11* (2013.01); *B65H 19/2269* (2013.01); *B65H 19/2223* (2013.01); *B65H 2301/51514* (2013.01); *B65H 2301/5152* (2013.01)

(58) Field of Classification Search

USPC ..... 242/533, 533.1, 533.2, 532.2, 532.3, 242/548, 548.4, 615.11

See application file for complete search history.

(56) References Cited

U.S. PATENT DOCUMENTS

| | | | | |
|---|---|---|---|---|
| 3,243,181 | A | 3/1966 | Lyman | |
| 3,592,403 | A * | 7/1971 | Schmitt et al. | 242/527.5 |
| 3,844,189 | A | 10/1974 | Jardine | |
| 4,033,212 | A | 7/1977 | Hasegawa | |
| 4,736,942 | A | 4/1988 | Wiley | |
| 5,660,350 | A * | 8/1997 | Byrne et al. | 242/533.4 |
| 6,802,353 | B2 * | 10/2004 | Malakouti et al. | 156/433 |
| 6,942,175 | B2 * | 9/2005 | Watkins et al. | 242/532.2 |
| 2005/0224205 | A1 | 10/2005 | Michler et al. | |
| 2010/0237179 | A1 * | 9/2010 | De Matteis | 242/521 |
| 2011/0240706 | A1 * | 10/2011 | Schwamberger et al. | 226/1 |

FOREIGN PATENT DOCUMENTS

| | | |
|---|---|---|
| GB | 1441993 | 7/1976 |
| GB | 2023104 A | 12/1979 |
| GB | 2264699 A | 9/1993 |
| WO | WO 2004/018167 A1 | 3/2004 |

* cited by examiner

*Primary Examiner* — Emmanuel M Marcelo
*Assistant Examiner* — Angela Caligiuri
(74) *Attorney, Agent, or Firm* — C. Brant Cook

(57) ABSTRACT

Processes for initiating a web winding process, more particularly a processes for initiating a web winding process that doesn't require the use of a threading rope or manually threading a tail of the web like known processes are provided.

24 Claims, 5 Drawing Sheets

PROCESS FOR INITIATING A WEB WINDING PROCESS

FIELD OF THE INVENTION

The present invention relates to processes for initiating a web winding process, more particularly to processes for initiating a web winding process that doesn't require the use of a threading rope or manually threading a tail of the web like known processes.

BACKGROUND OF THE INVENTION

Processes for initiating web winding processes are known in the art.

Conventional processes for initiating web winding processes include processes for initiating web winding processes that wind web materials into wide rolls, such as 254 cm wide rolls often called logs. Known processes for initiating web winding processes include forming a threading strip or tail of the web material prior to initiating the winding of the web material, for example about a core. For example, the threading strip or tail of the web material is attached to a threading rope. The threading rope travels over pulleys that follow the web path of the web material through the winder to the log winding location. In a typical winding operation, a tail is attached to a threading rope, which pulls the web through at a slow speed. Once reaching the winding area, the winder is stopped. The tail is then manually removed from the threading rope and attached to a core or placed in a position to be adhered to the core when the winder restarts or when a core is inserted as part of a restart process. Such a process for initiating a web winding process that utilizes a threading strip and/or a tail and/or threading rope are relatively time consuming and inefficient since a web handling system employing a web winding component cannot be operated even close to its optimal operating speed, such as greater than 2000 ft/min to 2500 ft/min, using such a process and they require the machine to be stopped at least two times for manual intervention, once to attach the tail and/or threading strip to the threading rope and once to remove it from the threading rope.

In addition to the above known processes, other automatic web feeding systems are known. However, in at least one of such automatic feeding systems, multiple winding modules are required adding to the cost and complexity of such a system. Additionally, this known process requires a web transport apparatus which conveys the web via vacuum, electrostatic charge or some other means to hold and control the web. In addition, in such a known process, if the web quality is insufficient for finished product, then the web must pass through the winder to a broke collection system or parent roll winding station.

Accordingly, there is a need for a process for initiating a web winding process wherein a winder with a single winding module may be utilized and/or wherein the winding component can be threaded with a full-width web at the full running line speed rather than a threading strip or tail or using a threading rope at slow speed.

SUMMARY OF THE INVENTION

The present invention fulfills the need described above by providing a process for initiating a web winding process wherein the web is wound around a core by a web winding component the operation of which is initiated before a first core is fed into the web winding component.

In one example of the present invention, a process for initiating a web winding process to wind a web into a wound web roll, the process comprising the steps of:

a. providing a web handling system comprising a web winder having a web winding component and a core feeder, wherein the web winding component is capable of winding a web about a core that it receives from the core feeder;

b. initiating operation of the web winding component;

c. introducing a web into the web winding component;

d. initiating operation of the core feeder such that a first core is fed from the core feeder to the operating web winding component; and e. winding the web about the first core to form a first wound web roll, is provided.

In another example of the present invention, a process for initiating a web winding process to wind a web into a wound web roll, the process comprising the steps of:

a. providing a web handling system comprising a web winder having a web winding component, wherein the web winding component is capable of winding a web about itself to form a wound web roll, for example a coreless wound web roll;

b. initiating operation of the web winding component;

c. introducing a web into the web winding component; and d. winding the web about itself to form a first wound web roll, is provided.

In another example of the present invention, a process for initiating a web winding process to wind a web into a wound web roll, the process comprising the steps of:

a. providing a web handling system comprising one or more rollers and/or one or more web handling elements, a web winder having a web winding component and a core feeder, wherein the web winding component is capable of winding a web about a core that it receives from the core feeder;

b. optionally, repositioning one or more rollers or one or more web handling elements (for example draw rollers, tension measure sensor rollers, bowed spreader rollers, etc.) from a miming position to a threading position to provide a less tortuous web path for threading of the web through the web handling system to the web winding component;

c. initiating operation of the web winding component;

d. operating air sources within the web handling system to progress a web through the web handling system towards the web winding component;

e. operating a web diverter within the web handling system to divert the web from a first web path, for example a web path leading to a web collection device, to a second web path leading to the web winding component;

f. introducing the web into the web winding component;

g. initiating operation of the core feeder such that a first core is fed from the core feeder to the operating web winding component;

h. initiating loading of a perforating component such that it begins perforating the web once the web begins winding about the first core;

i. winding the web about the first core to form a first wound web roll; and j. optionally, repositioning one or more of the rollers and/or one or more of the web handling elements (for example draw rolls, tension measure sensor rolls, bowed spreader rolls, etc.) within the web handling system to their running position after the web begins winding about the first core, is provided.

In yet another example of the present invention, a process for initiating a web winding process to wind a web into a wound web roll, the process comprising the steps of:

a. providing a web handling system comprising one or more rollers and/or one or more web handling elements, and a web winder having a web winding component, wherein the web winding component is capable of winding a web about itself to form a wound web roll, for example a coreless wound web roll;

b. optionally, repositioning one or more rollers or one or more web handling elements (for example draw rollers, tension measure sensor rollers, bowed spreader rollers, etc.) from a running position to a threading position to provide a less tortuous web path for threading of the web through the web handling system to the web winding component;

c. initiating operation of the web winding component;

d. operating air sources within the web handling system to progress a web through the web handling system towards the web winding component;

e. operating a web diverter within the web handling system to divert the web from a first web path leading to a web collection device to a second web path leading to the web winding component;

f. introducing the web into the web winding component;

g. initiating loading of a perforating component such that it begins perforating the web once the web begins winding about itself;

h. winding the web about itself to form a first wound web roll; and i. optionally, repositioning one or more of the rollers and/or one or more of the web handling elements within the web handling system to their running position after the web begins winding about itself, is provided.

Accordingly, the present invention provides a novel process for initiating a web winding process to wind a web into a wound web roll.

DETAILED DESCRIPTION OF THE INVENTION

Definitions

Figure 1:
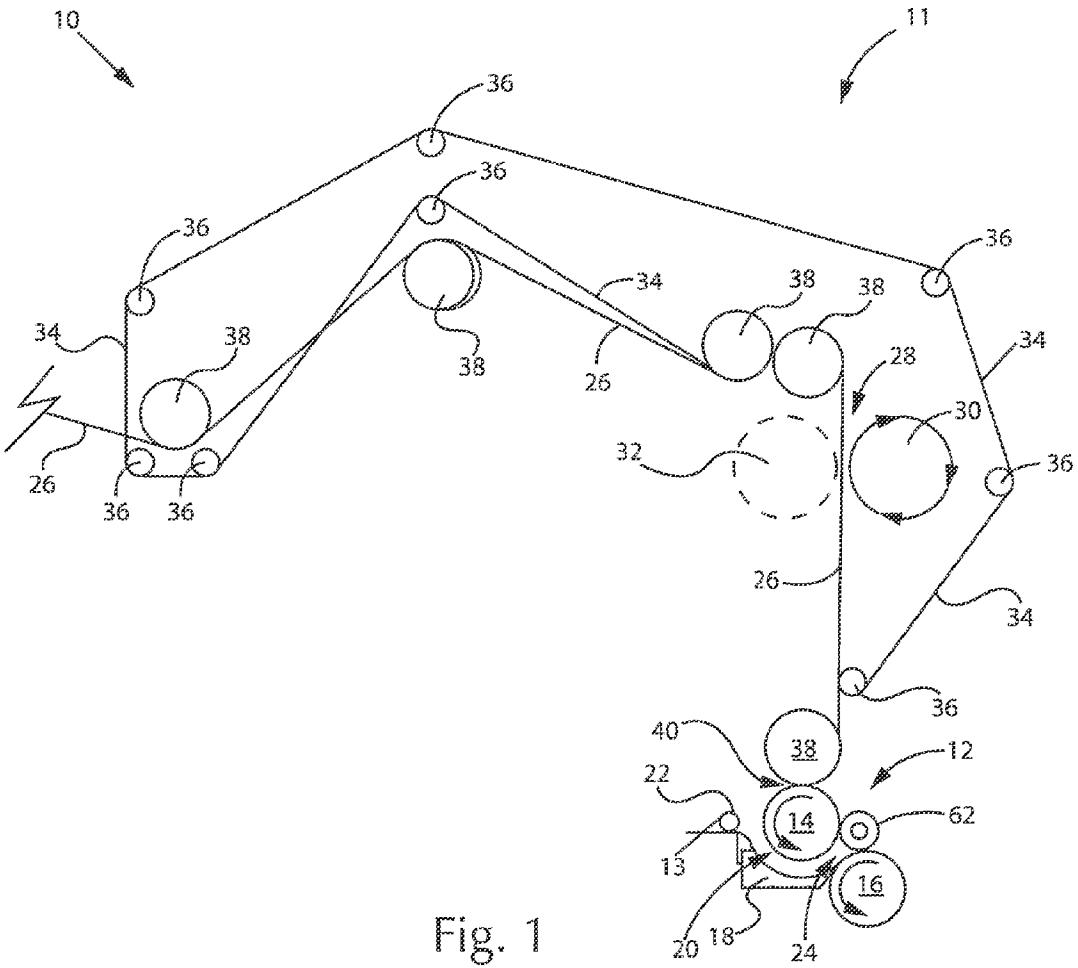
Fig. 1 PRIOR ART
FIG. 1 is a schematic representation of a prior art process for initiating a web winding process.

"Web" as used herein means a substantially continuous and/or greater than about 100 cm and/or greater than about 150 cm and/or greater than about 300 cm and/or greater than about 500 cm and/or greater than about 1000 cm in length material. The web may be any width. In one example, the width of the web may be greater than 25.4 cm and/or greater than 50.8 cm and/or greater than 127 cm and/or greater than 254 cm and/or greater than 381 cm and/or greater than 508 cm. Non-limiting examples of materials for the web include fibrous elements (such as fibers and/or filaments), films, metals, and textiles. In one example, the web is a highly permeable and/or high stretch web. In one example, the web is a fibrous structure such as paper or another type of non-woven.

"Log" and/or "wound web roll" as used herein, refers to a length of web convolutely wound either about a core, or without a core, such as a solid center roll, or about a mandrel which is subsequently removed to create a "coreless" roll. The log will be of a width essentially equal to the winding web width. The web wound into the log may be perforated into individual sheet length increments such as 4 inch sheets or 11 inch sheet. The log may be wound with a desired number of sheets and/or may be wound to a desired diameter such as greater than 3.5 inches. The sheet count and/or diameter of the log will equal that of the desired final consumer rolls. The log may subsequently be cut into multiple rolls of a width desired for consumer use such as 4 inches, 4.5 inches or 11 inches.

"Web handling system" as used herein means a machine that functions to interact with a web, such as move, direct and/or guide a web along one or more web paths. In one example, the web handling system comprises a web winder. In another example, the web handling system comprises a web winder and a web diverter.

"Web path" as used herein means a course along which a web travels through the web handling system.

"Web winder" as used herein means one or more components that function to convolutely wind a web into a wound web roll (also referred to as a log). The web winder may be a surface winder, a center winder or a hybrid combination thereof. In a surface winder, the web is wound onto a core to form a wound web roll via contact with belts and/or rotating rollers which rotate the log via surface contact. In a center winder, a core is rotated in order to wind a web into a wound web roll around the core. Typically, this core is mounted on a mandrel that rotates at high speeds at the beginning of a winding cycle and then slows down as the diameter of the wound web roll increases. A hybrid winder may contain a combination of some or all aspects of both a surface winder and a center winder. It should be noted, the prior art is not consistent in designating what is and is not a winder or rewinder. For instance, rewinders are sometimes called winder and winders are sometimes called rewinders. In addition to the log winding function, the web winder apparatus may contain equipment to perform other operations to the web such as spreading or wrinkle removal, tensioning, web tension measurement, web metering (speed control) and perforating. In one example, the web winder comprises a web winding component. In another example, the web winder comprises a web winding component and a core feeder. In still another example, the web winder comprises a web winding component and a perforating component. In yet another example, the web winder comprises a web winding component, a core feeder, and a perforating component.

"Web winding component" as used herein means a component of a web winder that functions to convolutely wind a web into a wound web roll, such as around a core.

"Core feeder" as used herein means a component of a web winder that functions to feed cores, for example individual cores, to a web winding component of the web winder.

"Web diverter" as used herein means a component of a web handling system that functions to change the direction of a web, in other words direct a leading edge of a web toward one of two or more downstream web paths or cut and direct a running web from a first web path to a second web path different from the first web path.

"Downstream web path" as used herein, relative to a component within a web handling system, means a web path that is after the component, such as a web path that is after a web diverter.

"Upstream web path" as used herein, relative to a component within a web handling system, means a web path that is before the component, such as a web path that is before a web winding component. An upstream web path may be before other components, such as before a web diverter.

"Web path surface" as used herein means a surface within a web handling system along which a web travels. In one example, a web contacts one or more web path surfaces during its movement along its web path. In another example, a web does not contact a web path surface during its movement along its web path, for example it may be moving on an air stream positioned between a web path surface and the web.

"Air Stream" as used herein refers to a flow of a fluid, for example a desirably laminar flow of air along at least one web path surface with a velocity that may be equal to or greater than the web velocity. The air stream may be supplied by one or more air sources such as an air foil, a blower, an air knife, an air nozzle, or a compressed air source. One or more air streams may be present during the web diverting operation to help control the leading edge of the web and direct it down the appropriate downstream web path.

"Sever", "Cut", and "Severing" as used herein means any process of creating separation in a web that creates two or more separate portions of the web. Examples may include, but are not limited to, typical shear cutting and/or tearing resulting from straining the web to the point of tensile failure. One or more severing elements may be used to sever the web. In one example, one or more severing elements moves at a velocity of at least 20 in/second and/or at least 40 in/second and/or at least 60 in/second and/or at least 80 in/second.

As used herein, the articles "a" and "an" when used herein, for example, "an anionic surfactant" or "a fiber" is understood to mean one or more of the material that is claimed or described.

Web Handling System

As shown in FIG. 1, a prior art web handling system 10 comprises a prior art web winder 11, such as a conventional surface winder, comprising a web winding component 12 and a core feeder 13. The web winding component 12 comprises an upper winding roller 14, a lower winding roller 16, and a core cradle 18 that forms a first gap 20 between itself and the upper winding roller 14 through which a core 22 from the core feeder 13 passes during a winding operation. The web winding component 12 may optionally comprise a rider roller (not shown).

Generally, the upper winding roller 14 and the lower winding roller 16 rotate in the same direction (as represented by arrows) and are spaced to form a second gap 24 through which a web 26 and/or a core 22, around which the web 26 may begin to wind, for example a log in the process of being wound, can traverse.

During operation of the prior art web winder 11, a web 26 is fed from an upstream web path source such as a web making apparatus (not shown) and/or a parent roll unwinding system (not shown) to the prior art web winder 11. Any known web processing operation upstream of the prior art web winder 11 may process the web 26 prior to entering the web winding component 12 of the prior art web winder 11. Such web processing operations may include, but not be limited to, embossing, lotioning, coating, printing, slitting, combining of two or more webs, perforating, combinations thereof, and the like. In one example as shown in FIG. 1, the prior art web winder 11 further comprises a perforating component 28 having an anvil 30 and a perforating roller 32. In one example, the lower winding roller 16 may operate at a speed that is different from the upper winding roller 14 and may follow a speed profile.

In order to initiate a web winding process using the prior art web handling system 10 as shown in FIG. 1, a threading rope 34 is utilized. A threading strip and/or tail (not shown) of a web 26 is manually attached to the threading rope 34. The threading rope 34 travels along and/or adjacent to the web path of web 26 towards the web winding component 12 of prior art web winder 11. Pulleys 36 are used to facilitate the movement of the threading rope 34 along and/or adjacent to the web path. The web path of web 26 further comprises additional rollers 38, such as draw rollers, spreader rollers, and tension measuring rollers, which are fixed and cannot be adjusted in and out of the web path of web 26. One or more of the rollers may be a driven roller over which the web 26 travels.

Once the threading rope 34 reaches the web winding component 12, the threading rope 34 is stopped and thus the web 26 is stopped. The threading strip and/or tail of the web 26 is then manually removed from the threading rope 34. The threading strip and/or tail is then inserted into the gap 40 formed between the upper winding roller 14 and a draw roller 38. The threading strip and/or tail is then attached to a core 22 or placed in a position relative to the upper winding roller 14 such that the threading strip and/or tail can be adhered to the core 22 when the prior art web winder 11 restarts or when a core 22 is inserted as part of a restart process. Once the web is in this position, the prior art web winder 11 and thus the winding of the web 26 about the core 22 is initiated. The manually intensive nature and slow processing of the prior art process are negatives that the present invention overcomes.

Figure 2:
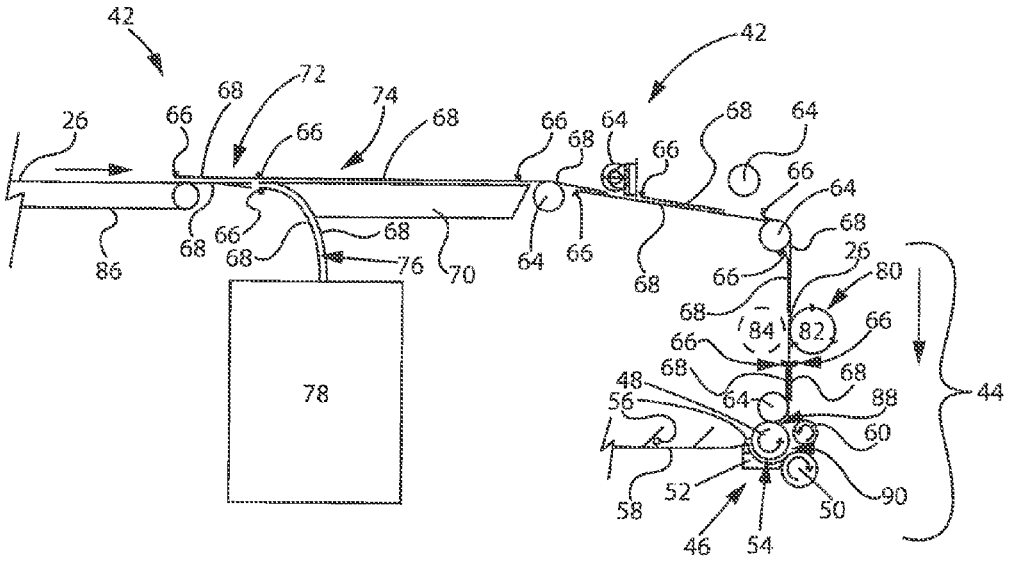
FIG. 2 is a schematic representation of an example of a process for initiating a web winding process according to the present invention.
Figure 3:
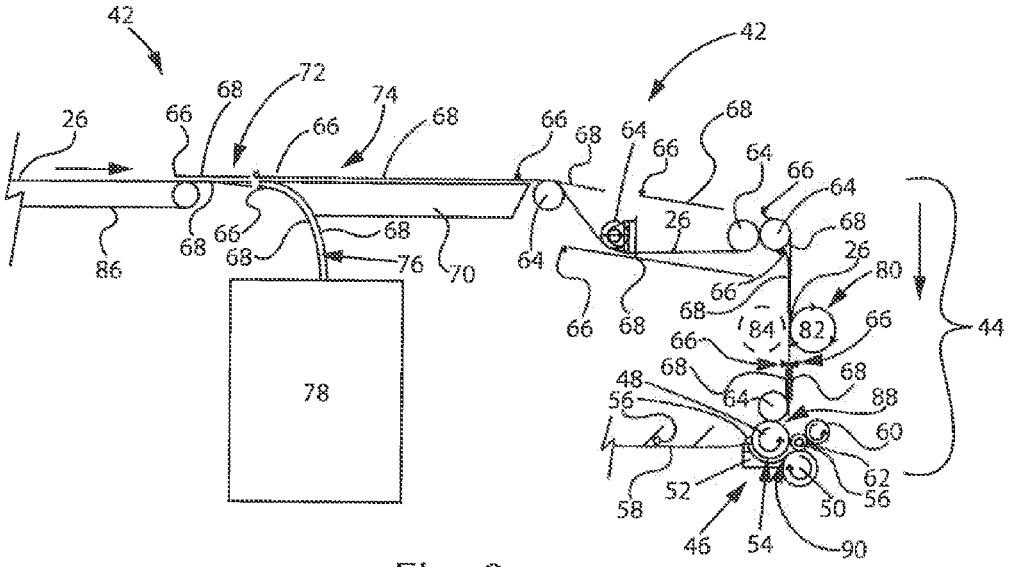
FIG. 3 is a schematic representation of FIG. 2 in a different state of operation.

In one example of the present invention, a process for initiating a web winding process to wind a web into a wound web roll comprising a web handling system 42 that utilizes a web winder 44 as shown in FIGS. 2 and 3. The web winder 44 comprises a web winding component 46, such as a conventional surface winder. The web winding component 46 comprises an upper winding roller 48, a lower winding roller 50, and a core cradle 52 that forms a first gap 54 between itself and the upper winding roller 48 through which a core 56 from a core feeder 58 passes during the winding operation. The web winding component 46 may further comprise an optional rider roller 60. The optional rider roller 60 can be attached to an actuation means (not shown) to permit the optional rider roller 60 to move as the diameter of a wound web roll 62 increases as the web 26 is wound about the core 56. The web handling system 42 may also comprise additional rollers 64, such as draw rollers, spreader rollers such as bowed spreader rollers, and tension rollers. The rollers 64 may function to control the speed and tension/strain of the moving web 26 and to change the direction of a web 26 passing through the web handling system 42 of the present invention on its way to the web winding component 46. In one example, the position of one or more of the rollers 64 may be adjustable to disengage and/or engage the web 26. For example, one or more of the rollers 64 may be in a first position, as shown in FIG. 2, which is disengaged (not contacting the web and/or not applying pressure to the web) from the web 26 during the process of initiating the web winding process of the present invention. After the web winding process has been initiated (for example once the web begins winding about a core in the web winding component), the disengaged rollers 64 may move to a second position, as shown in FIG. 3, which engages the web 26 (contacts the web and/or applies pressure to the web).

In addition to various rollers 64 that help manage the flow of a web 26 through the web handling system 42 of FIGS. 2 and 3, the web handling system 42 may further comprise one or more air sources 66 (even though air is specified, it is a non-limiting example of a suitable fluid, such as a gas) that provide air and/or other fluids such as other gases into the web path. The air may be in the form of air streams that contact the web 26 and facilitate its traversing the various sections of the web handling system 42 on its way to the web winding component 46. One or more air sources 66 may be associated with one or more web guide plates 68 that aid in guiding the web 26 through the web handling system 42. The position of one or more of the air sources 66 and web guide plates 68 may be adjustable to disengage and/or engage the web 26. For example, one or more of the air sources 66 and web guide plates 68 may be in a first position, as shown in FIG. 2, which directs the web 26 along its threading web path. After the web winding process has been initiated (for example once the web begins winding about a core in the web winding component), the air source 66 and web guide 68 may move to a second position, as shown in FIG. 3, which is disengaged from the running web's 26 web path.

In one example, the web handling system 42 comprises an air conveyor 70 which creates a moving air cushion between its surface and the web 26 upon which the web 26 travels over the air conveyor 70.

In another example, the web handling system 42 comprises a web diverter 72 which is capable of directing the web 26 down two or more different downstream web paths, for example one downstream web path 74 may lead to the web winder 44 and another downstream web path 76 may lead to a collection device 78, such as a broke system for fibrous structures, a repulper, a shredder, and/or a parent roll winder. The web diverter 72 may function to sever the web 26 immediately before or instantaneous with the diverting of the web 26 from one downstream web path to a different downstream web path such that a trailing edge of the web 26 continues down the downstream web path 74 ("second downstream web path") and a new leading edge of the web 26 proceeds down the downstream web path 76 ("first downstream web path"). In one example, the web handling system 42 may comprise one or more web diverters 72. For example, a web diverter 72 may be positioned within the web handling system 42, for example upstream of the web winding component 46, to be capable of diverting the web 26 from a web path that leads to a first web winder (not shown) to a web path that leads to a second web winder (not shown). In one example, the web handling system 42 comprises a web defect detection system (not shown), such as an optical or visual detection system, for detecting defects in the web 26 during the process of the present invention. The web defect detection system may automatically detect web defects during the process of the present invention. When and if a defect in the web 26 is detected, the web diverter 72 diverts the web 26 from downstream web path 74 (second downstream web path) to downstream web path 76 (first downstream web path). In another example, the web diverter 72 may divert the web 26 from downstream web path 76 (first downstream web path) to downstream web path 74 (second downstream web path).

The web winder 44 may further comprise a perforating component 80 capable of perforating the web 26 prior to the web 26 being wound into a wound web roll 62 comprising a perforating roller 82 and an anvil 84 that perforates the web 26, for example to create cross-machine direction perforation lines in the web 26 prior to the web 26 entering the web winding component 46. The perforating roller 82 and anvil 84 may be disengaged from one another during the process of initiating winding of a web 26 so that the web may pass through the perforating component 80 without being perforated and/or contacted by either the perforating roller 82 or the anvil 84. Once the web 26 has begun winding about a core 56, the perforating roller 82 and anvil 84 may be engaged to start perforating the web 26.

The web handling system 42 of the present invention as shown in FIGS. 2 and 3 may operate as follows. Initially, a web 26 may be transported into the web handling system 42 via a web path that comprises a conveyor 86, such as a vacuum conveyor. The air sources 66 are capable of supplying one or more air streams upon which the web 26 may travel within the web handling system 42. Air sources 66, such as air knives, for example Coanda air knives, may propel the web 26, such as its leading edge, by contacting the web 26 with air streams, such as high velocity air streams, for example about two times the web speed. The air streams may guide the web 26 along and/or between one or more web guide plates 68, which may be straight and/or curved guide plates. In places where the web 26 is not traveling along a guide plate 68, such as an unsupported gap, for example such as through the perforating component 80, the air sources 66 and/or web guide plates 68 may be arranged downstream of the perforating component 80 to create a suction force to ensure that the leading edge of the web 26 is drawn along a desired downstream web path as the leading edge of the web 26 exits the perforating component 80.

In another example, the web winder 44 may comprise one or more movable web guide plates 68 capable of moving between two or more positions to permit one or more of the rollers 64 to move between a position disengaged from the web 26 to a position engaging the web 26.

In one example, the air sources 66 may be used in conjunction with an air conveyor 70, which may supply an air stream upon which the web 26 may travel within the web handling system 42, to help move the web 26 along its web path through the web handling system 42. At initial start up, the web 26 may be directed by the web diverter 72 down a downstream web path 76 such that the web 26 is collected in a collection device 78. This web direction may be maintained until such point in time that web winding component 46 and rollers 64 (at least those rollers that are engaged with the web) of the web handling system 42 have reached a desired speed, for example a speed nearly equal to the speed of the web handling process upstream of the web diverter 72. For example the web handling system speed may be capable of maintaining a web velocity of greater than 500 ft/minute and/or greater than 1000 ft/minute and/or greater than 2000 ft/minute as the web 26 enters and/or passes through the web winding component 46. Once the web handling system 42 reaches a desired speed the web 26 may be cut by the web diverter 72 with the new leading edge of the web 26 being directed to the downstream web path 74 that includes the web winding component 46.

The leading edge of the web 26 may travel along the downstream web path 74 in a substantially straight path rather than in a serpentine path like known web handling systems. As shown in FIGS. 2 and 3, the web 26 travels along the downstream web path 74 in a substantially straight path across an air conveyor 70 and over one or more rollers 64. The web 26 then travels around one or more rollers 64 and changes direction. The web 26 then travels through a perforating component 80. After exiting the perforating component 80, the web 26 may then reach another roller 64 that again causes the web 26 to change direction. This roller 64 may form a nip or small gap 88 with the upper winding roller 48 of the web winding component 46 through which the web 26 passes. The web 26 then travels around the upper winding roller 48 at which point it is contacted by a core 56, which may comprise an adhesive to facilitate attaching the web 26 to the core 56. The core 56 may be inserted into the gap 54 formed between the upper winding roller 48 and the core cradle 52. The core 56 is fed to the gap 54 via the core feeder 58. In one example, the core feeder 58 feeds a core 56 to the gap 54 simultaneously or substantially simultaneously to the time the leading edge of the web 26 enters the gap 54. In another example, the core feeder 58 feeds a core 56 to the gap 54 slightly after the leading edge of the web 26 enters the gap 54, for example after 4 inches of web 26 have entered the gap 54 or after 8 inches of web 26 enter the gap 54. The core 56 may comprise an adhesive, such as a glue stripe on the surface of the core 56, which may adhere the leading edge of the web 26 to the surface of the core 56 such that as the core 56 rolls through the gap 54 between the upper winding roller 48 and core cradle 52, the winding of the web 26 around the core 56 may proceed. The core 56 and the web 26 which is winding on the core 56 may proceed through the gap 54 formed by the core cradle 52 and the upper winding roller 48 to a gap 90 formed by the upper winding roller 48 and the lower winding roller 50. Contact on the surface of the web roll being wound ("winding log") by the rotating upper winding roller 48, lower winding roller 50 and optionally a rider roller 60 continues to rotate the winding log thus continuing to wind the web 26 about the core 56 to produce the wound web roll 62. The web 26 is then cut and/or broken to create a trailing edge of the web 26 that completes the wound web roll 62.

One or more cores 56 used within the process of the present invention may exhibit an external diameter of less than 10 cm and/or less than 8 cm and/or less than 6 cm and/or less than 4 cm.

Once the wound web roll 62 is produced and/or exits the web winding component 42, another core 56, such as a second core, which may have a glue stripe, may be introduced into gap 54 and the web 26 may be wound about the core 56 to form another wound web roll 62. A wound web roll 62, after exiting the web winding component 42, may be divided into two or more finished product web rolls (not shown), such as be cutting and/or sawing the wound web roll 62. This process may be repeated for so long as desired or until a condition occurs, such as a defect in the web 26, or such as a break in the web 26 within the web handling system 42, at which time the web diverter 72 may act to divert the web 26 from the downstream web path 74 to the downstream web path 76. This diverting of the web 26 may be automatic and allows one or more of the operations upstream of the web diverter 72 to continue to run. Once the condition is fixed or alleviated, the web 26 may be diverted once again by the web diverter 72 to the downstream web path 74 that leads to the winding component 46. The web winding component 46 and/or its core feeder 58 may not be operating while the web 26 is being diverted to the downstream web path 76. The web winding component 46 and/or its core feeder 58 may begin operating before the web 26 is diverted to the downstream web path 74.

In one example, the web winding component 46, except for its core feeder 56, may be operating while the web 26 is being diverted down the downstream web path 76 so that one or more wind cycles may occur before the web diverter 72 diverts the web 26 to the downstream web path 74.

In one example, the web 26 is traveling at a speed established by the upstream operations of the web handling system 42 and then contacts the web winding component 46, which is operating at a speed substantially identical to the speed established by the upstream operations.

In order to facilitate easier automatic threading, one or more of the rollers 64 and/or web guide plates 68 and/or air sources 66 may be associated with the web handling system 42 so that they can move to a first position, as shown in FIG. 2, to enable threading of the web 26 along a less tortuous web path through the web handling system 42 to the web winding component 46. After threading, one or more of the rollers 64 and/or web guide plates 68 and/or air sources 66 may then move to a second position, as shown in FIG. 3, which may initiate contact between all of the rollers 64 and the web 26 and may increase the amount of wrap of the web 26 on the rollers 64. This may include achieving a desired amount of wrap on web handling process devices such as, but not limited to, bowed spreader rollers, tension measuring sensor rollers (for example an idler roller mounted on load cells) and driven draw rollers. The rollers 64 and/or web guide plates 68 and/or air sources 66 may be moved from a first position to a second position via an actuator, for example that will begin to lower the rollers 64 into the web path once the leading edge of the web 26 has passed completely though the web winding component 46 and has begun winding into a wound web roll 62. Roller speeds upstream and/or downstream of the one or more adjustable rollers 64 may be changed to compensate for the changing span length as the adjustable rollers 64 are moved through the web path. Tension feedback from an active tension measuring sensor roller within the process may be used to control the speed of the web winding component 46 and/or the rollers 64 within the web handling system 42 to maintain a constant or substantially constant web tension on the web 26 while the rollers 64 and/or web guide plates 68 and/or air sources 66 move from one position to the other.

Figure 4:
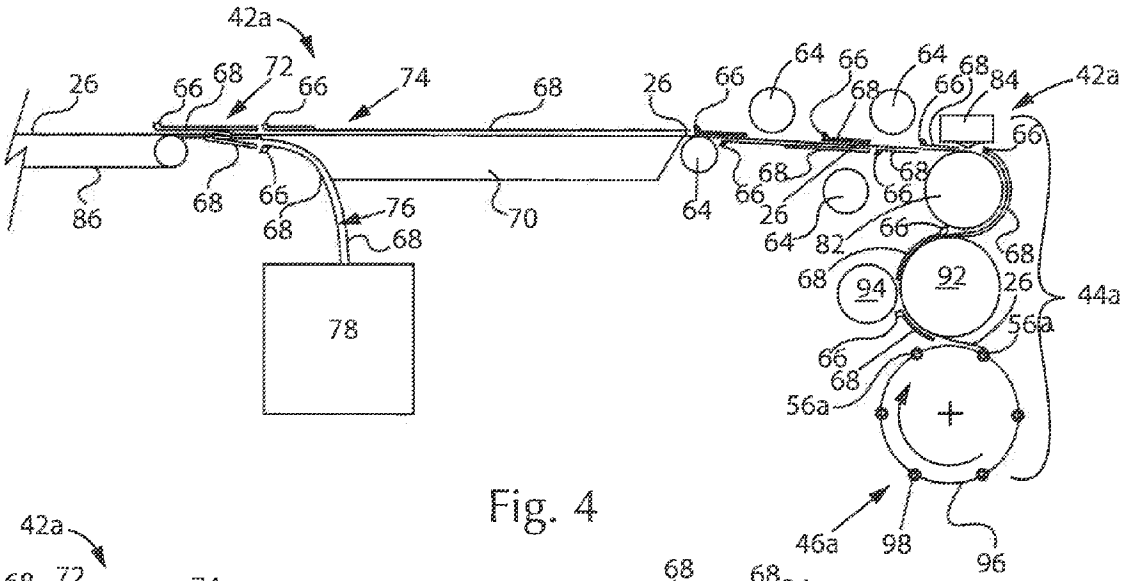
FIG. 4 is a schematic representation of another example of a process for initiating a web winding process according to the present invention.
Figure 5:
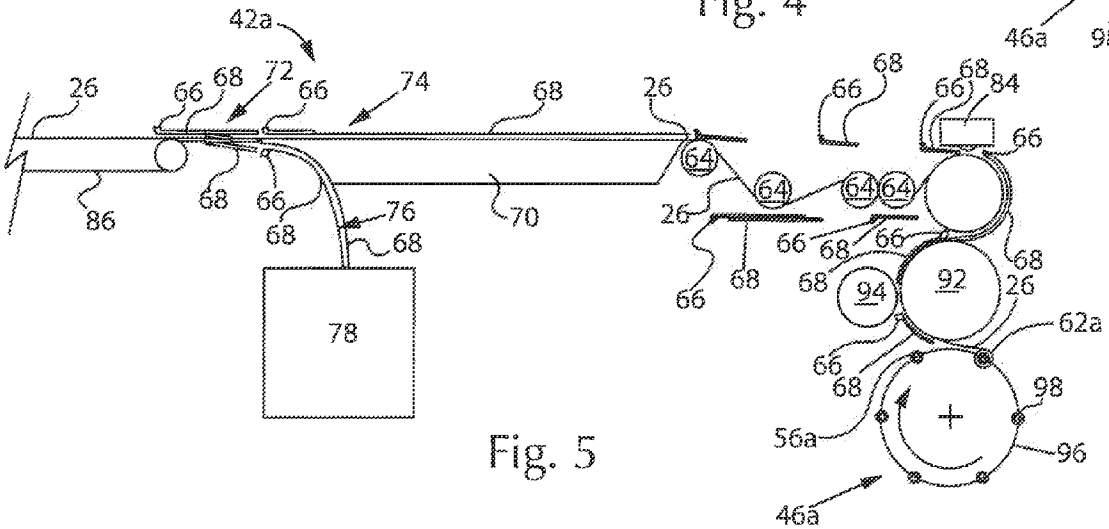
FIG. 5 is a schematic representation of FIG. 4 in a different state of operation.

As shown in FIGS. 4 and 5, in another example of a process for initiating a web winding process of the present invention, a web handling system **42*a* comprises a conventional center winder as a web winding component 46*a*. The web handling system 42*a* comprises a web winder 44*a* comprising the web winding component 46*a*. The web winding component 46*a* comprises a bed roll 92 and a chopper roll 94, which interact with one another to apply tension to the web 26 to result in the web 26 breaking at a perforation in the web 26. The web winding component 46*a* comprises a turret 96, which comprises a plurality of mandrels 98 that receive cores 56*a* from a core feeder (not shown). The turret 96 rotates the mandrels 98 with their respective cores 56*a* to various positions, such as core loading, core gluing, pre-spin, which is immediately prior to the position at which a web 26 contacts a core 56*a* and begins winding about the core 56*a*, wound web roll 62*a* removal from its mandrel 98. The remaining sections and processes of the web handling system 42*a* are similar to the web handling system 42 described above and shown in FIGS. 2 and 3**.

Figure 6:
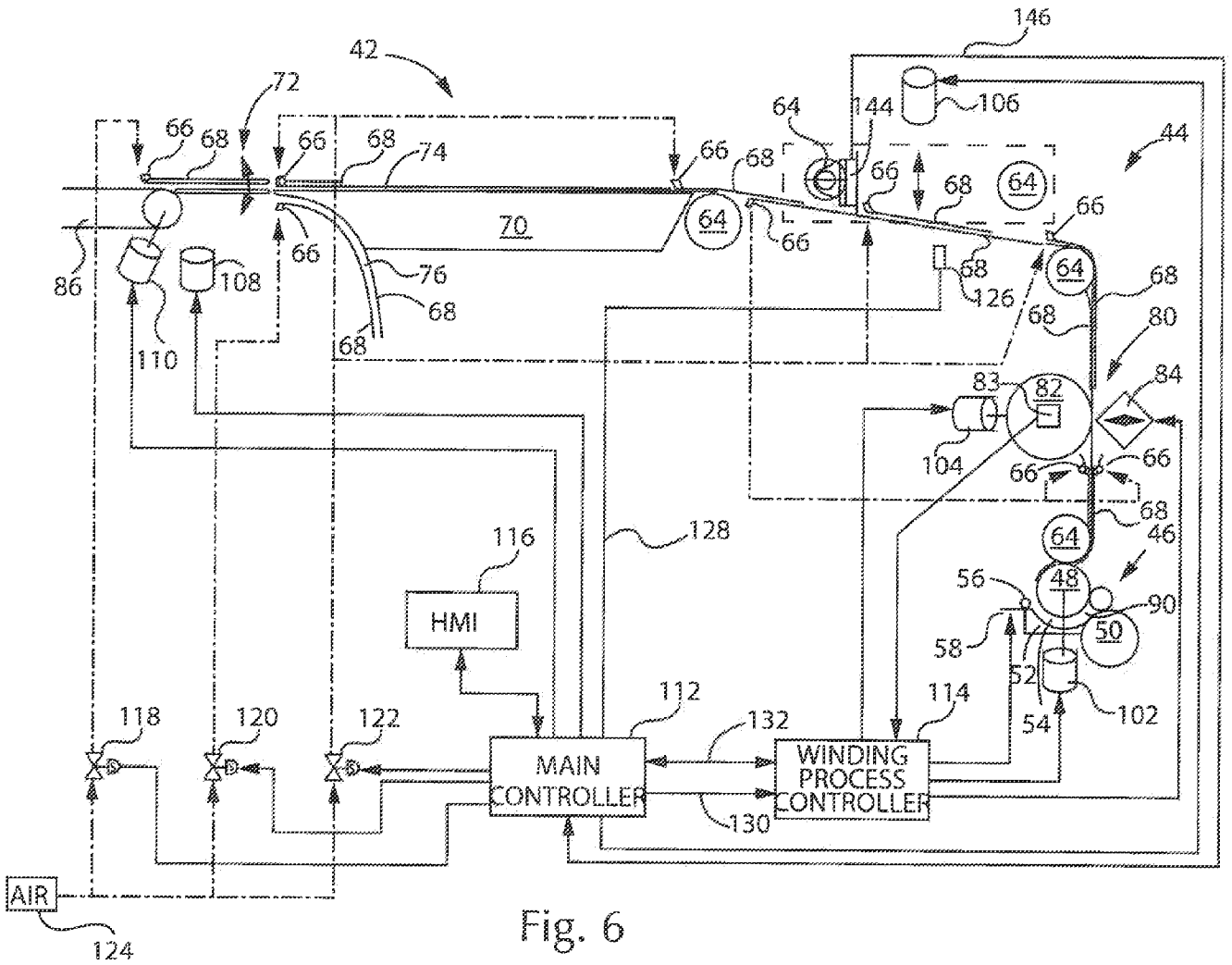
FIG. 6 is a schematic representation of FIG. 2 illustrating an example of a control system associated therewith.

FIG. 6 illustrates one example of a control diagram for the web handling system 42 of the present invention. A similar control process may be used with the web handling system **42*a* of the present invention. A main process controller 112 controls the web handling process upstream of the web diverter 72 such as the conveyor 86 and its accompanying conveyor motor 110. A separate winding process controller 114 controls all of the functions and timing sequences of the web winder 44 for example the functions such as the speed of the winder main drive motor 102, the actuation of the core feeder 58 and the speed of the perforating roller 82 and its accompanying perforating roller motor 104. The perforating roller 82 may comprise an encoder 83 which provides position feedback and machine cycle reference timing information to the winding process controller 114. The main controller 112 provides a speed reference signal 130 to the web winder process controller 114. The web winder process controller 114 subsequently controls the speed of the web winder 44. The main controller 112 and the web winder process controller 114 may share any number of communication signals 132** between them such as timing signals, enable signals, and state information. These communications may be in the form of hardwired digital signals, analog signals, or via one or more digital communication methods and protocols known in the art.

The main controller 112 may also control solenoid valves which turn on and off the flow of compressed air 124 to the air sources 66. A first solenoid valve 118 controls the air supply to the air sources 66 in the web path upstream of the web diverter 72. This first solenoid valve 118 may be actuated any time in synchrony with the winder cycle and typically before the web diverter 72 is actuated. A second solenoid 120 controls the supply of air to the air sources 66 in the downstream web path 76 leading to the web collection device 78. This second solenoid valve 120 may be actuated any time in synchrony with the winder cycle before or after the web diverter 72 cuts and directs the web 26 toward downstream web path 76. A third solenoid valve 122 controls the supply of air to the air sources 66 in the downstream web path 74 through the web winder 44.

A human-machine interface (HMI) 116 may be included in the system to enable an operator to change settings, such as timing settings associated with the process. The HMI 116 may also allow for manually starting and stopping of the web winder 44 or initiation of the web diverting process or starting the process of initiating the web winding process. The HMI 116 may communicate with the main controller 112 via any know digital communication method and protocol.

As described in FIGS. 2-5, one or more of the web handling rollers 64 and/or web guide plates 68 and/or air sources 66 may be may be associated with the web handling system 42 so that they can move to a first position to enable threading of the web 26 through the web winder 44 to a second position for ongoing operation of the web winder 44. An actuator 106 may be provided to enable this movement from the first position to the second position. Timing, speed and positioning of the actuation may be controlled by the main process controller 112. One or more of the movable rollers 64 may be associated with a load cell 144 to provide for measurement of tension in the web 26. This tension measurement signal may be provided to the main process controller 112 and used to control the speed of rollers 64 and the web winding component 46 downstream of the load cell 144 to maintain a nearly constant web tension in the web 26 as the movable rollers 64 move from the first position to the second position. The main process controller may perform calculations to interpret the force measurement signal 146 to compensate for the change in wrap angle of the web 26 around the roller 64 which comprises the load cell 144 as the roller 64 moves from the threading position to the normal running position.

In one example, the web handling system 42, 42*a* and their components may be controlled by standard controlling equipment, microprocessors, and software known to those of skill in the art. For example, the main process controller 112 may be a standard programmable logic controller (PLC), such as an Allen-Bradley 1756 ControlLogix® Controller commercially available from Rockwell Automation, Milwaukee, Wis. In another example, the winding process controller 114 may be a motion controller, such as a Robox® RBXM Modular Motion controller available from Robox S.P.A., Ticino, Italy. The load cell may be an ABB Pressductor® load cell, commercially available from ABB Inc., Schaumberg, Ill.

Figure 7:
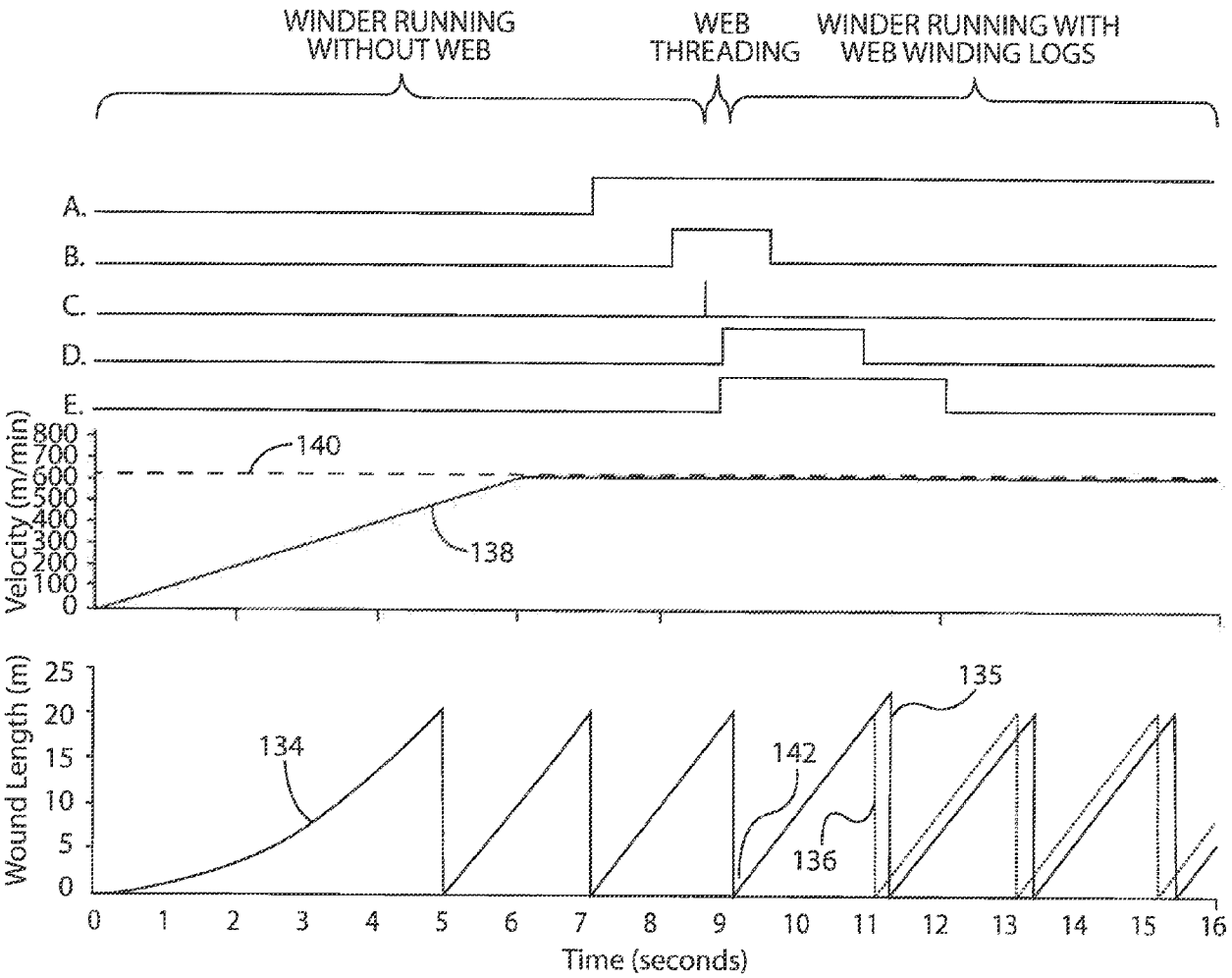
FIG. 7 is a graphical representation of the timing sequences associated with the process, such as shown in FIGS. 2 to 6, for initiating a web winding process according to the present invention.

FIG. 7 is a graphical representation of the timing sequences associated with the process for initiating a web winding process, for example as exemplified in FIGS. 2-5 and the control process shown in FIG. 6, according to the present invention. These charts represent the web winder's 44 velocity 138, the upstream velocity 140 of the corresponding web handling system (not shown) upstream of the web diverter 72, the web winding component's 46 winding cycle 134 and various timing signals A-E which represent the timing of various activities with relation to the web winder's 44 winding cycle 134. The winding cycle 134 is represented based upon the length of wound web 26 about the core 56. Position feedback received from the perforating roller 82 encoder 83 is used by the winding process controller 114 to determine the web winder's position in the winding cycle 134, During the normal winding process (after the initiation of the winding process), when the final desired length is reached, the web 26 is cut or forced to break along the line of perforation at which point the finished wound web roll (log) 62 is ejected and a new core 56 is inserted by the core feeder 58 thus restarting the winding sequence.

According to the present invention, when the web winder 44 begins to run, following the velocity profile 138, the winding cycle 134 is being calculated and the web winder 44 is operating according to the winding cycle 134. All motions and speed profiles in the web winder 44 associated with the winding cycle 134 such as the rider roller 60 motion and the lower winding roller's 50 velocity profile are active except for the actuation of the core feeder 58 which is disabled. Additionally, the perforating component's 80 anvil 84 is not loaded to engage with the blades on the rotating perforating roller 82.

Signal A represents the enabling of the core feeder 58. When signal A is "off" the core feeder 58 will not insert cores 56, when signal A is "on" the core feeder 58 is enabled and will insert cores 56 at the appropriate point in the winding cycle 134 as controlled by the web winder process controller 114.

Signal B represents the state of the solenoid valve 122 which supplies air to the air sources 66 in the web winder's 44 web path 74. When this signal B is "off", the valve is closed and no air flows. When signal B is "on" the solenoid valve 122 is opened and air flows from the air sources 66 in the web winder's 44 web path 74 to convey the leading edge of the web 26 through the web path 74. The timing of signal A is controlled via the main process controller 112 based upon timing signals 132 communicated from the winding process control 114 to enable actuation of the solenoid valve 122 at the appropriate time in the winding cycle 134. The valve may be actuated prior to the actuation of the web diverter 72 to ensure that air is flowing from the air sources 66 when the web 26 is introduced into the web winder's 44 web path 74 via actuation of the web diverter 72.

Signal C represents the timing of the web diverter 72. The "pulse" represents the timing signal communicated from the web winder process controller 114 to the main controller 112 which subsequently controls the web diverter actuator 108 causing the web diverter 72 to cut and divert the web 26 from downstream web path 76 to downstream web path 74 leading to the web winder 44. The timing of the web diverter 72 actuation is control by the web winding process controller 114. The timing is based upon the known distance from the web diverter 72 to the core feeder 58 and is set such that the leading edge of the web 26 reaches the gap between the upper winding roller and the core cradle 54 concurrent with or slightly before the time when the first core 56 is inserted by the core feeder 58.

Signal D represents the loading of the anvil 84. The anvil will begin to move to engage the rotating perforating roller 82 when the signal turns "on". The signal turning "off" represents the point at which the anvil 84 reaches its final position and the perforating component 80 begins to perforate the web 26.

Signal E represent the movement of the some of the rollers 64 as controlled by actuator 106. In this example once the web 26 passes the perforating component 80 the actuator 106 begins to move the moving rollers 64. Because of the time required for this motion, the rollers 64 can begin to move prior to the leading edge of the web 26 reaching the gap between the core feeder and core cradle 54, however, the moving rollers 64 will not contact the web 26 until after the leading edge of the web 26 has begun to wind 142 around the core 56 and has passed through the gap between the upper winding roller 48 and lower winding roller 50 to begin forming a first wound web roll (log) 62.

In the web winder 44 of the present invention, perforation on the web 26 is required to enable breaking the web 26 to end the winding of a first wound web roll (log) 62 and allow for the web to begin winding around a new core 56 to begin forming a second wound web roll (log) 62. In one example, the first wound web roll 62 exhibits a diameter of at least 3 inches when it exits the web winding component 42. Because the anvil 84 may not begin to load until after the leading edge of the web 26 has passed and depending upon the time required for the anvil 84 to move, the web winder 44 speed and the desired length of web 26 wound onto the wound web roll (log) 62, the anvil 84 may not be loaded and thus the web 26 not perforated at the time in the original winding cycle 136 at which the winding of the first log 62 should end. In this case the winding process controller 114 may calculate a modified winding cycle 135 to enable winding an additional length of web 26 onto the first wound web roll (log) 62 to allow extra time to ensure that the anvil 84 is loaded and the web 26 is being perforated before ending the winding of the first wound web roll (log) 62. This first log 62 would thus be wound to a larger diameter and with more total wound length of web 26 than subsequent wound web rolls (logs) 62. This first wound web roll (log) 62 may be automatically reject thus not sent on to subsequent processing and packing operations (not shown).

Referring to FIG. 6, one or more web detection sensors 126 may be placed along web path 74 through the web winder 44. These sensors 126 may be photoelectric, ultrasonic, laser or any other known presence detection sensors. The web detection sensor 126 sends a web presences signal 128 to the main controller 112 indicating the presence or absence of the web 26. Based upon the timing of the web diverter 72 actuation and the known distance between the web diverter 72 and the web detections sensor 126, the point in time or point in the winding cycle 134 at which the leading edge of the web 26 should arrive at the web detection sensor 126 can be determined. If the web 26 is not detected by the web detection sensor 126 at or around this determined point in time or point in the winding cycle, it can be concluded that a jam has occurred in the system stopping the progress of the web 26 through the web path 74. In this case the main controller 112 may send a signal to the diverter actuator 108 to activate the diverter 72 to cut the web 26 and a direct back down the web path 76 leading to the web collection device 78 thus preventing a stop in the upstream web process.

Even though the above description relates to examples that utilize cores to wind the web, coreless wound web rolls may also be generated by the process of the present invention.

The wound web rolls (logs) 62 may exhibit any suitable external diameter known in the art for the specific web material. For example, if the web material is for convenience sake a fibrous structure, such as toilet tissue and/or paper towel, the external web diameter of the wound web roll 62 may be less than 30 cm and/or less than 25 cm and/or less than 20 cm and/or less than 15 cm and/or less than 10 cm and/or less than 8 cm and/or greater than 4 cm and/or greater than 6 cm. For example, if the web material is a food film wrap, the external web diameter of the wound web roll 96 may be less than 10 cm and/or less than 8 cm and/or less than 6 cm and/or greater than 2 cm and/or greater than 4 cm.

In one example, the web 26 exhibits a width of greater than 10 inches and/or greater than 20 inches and/or greater than 40 inches and/or greater than 50 inches and/or greater than 75 inches and/or greater than 100 inches at the point of entering the web winding component 46, such as coming into contact with the upper winding roller 48.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for initiating a web winding process after a stop, the process comprising the steps of:

a. providing a web handling system comprising a web winder having a web path, a web winding component and a core feeder, wherein the web winding component is configured to wind a web about a core that it receives from the core feeder;

b. initiating operation of the web winding component after a stop and before introducing the web into the web winding component;

c. introducing the web through the web path via web guides and air streams into the operating web winding component;

d. initiating operation of the core feeder such that a first core is fed from the core feeder to the operating web winding component after operation of the web winding component has been initiated and concurrent with introducing the web through the web path; and e. winding the web about the first core to form a first wound web roll.

2. The process according to claim 1 wherein an adhesive is applied to an exterior surface of the first core.

3. The process according to claim 1 wherein the web handling system further comprises a perforating component capable of perforating the web prior to the web being wound into the first wound web roll.

4. The process according to claim 3 wherein the process comprises operating the perforating component such that the perforating component perforates the web.

5. The process according to claim 1 wherein the web handling system further comprises a web diverter component capable of diverting the web from a first downstream web path to a second downstream web path different from the first downstream web path, wherein the web diverter component is positioned upstream of the web winding component.

6. The process according to claim 5 wherein the first downstream web path leads to a web collection device.

7. The process according to claim 5 wherein the second downstream web path leads to the web winding component.

8. The process according to claim 7 wherein the web handling system comprises a web defect detection system for detecting defects in the web during the process.

9. The process according to claim 8 wherein the web handling system's web diverter component diverts the web from the second downstream web path to the first downstream web path when defects in the web are detected.

10. The process according to claim 5 wherein the process comprises operating the web diverter such that the web diverter diverts the web from the first downstream web path to the second downstream web path.

11. The process according to claim 1 wherein the web handling system further comprises air sources that are capable of supplying one or more of the air streams upon which the web travels within the web handling system.

12. The process according to claim 11 wherein the process comprises operating the air sources such that the web travels on one or more of the air streams.

13. The process according to claim 1 wherein the web handling system further comprises an air conveyor that supplies one or more of the air streams upon which the web travels within the web handling system.

14. The process according to claim 13 wherein the process comprises operating the air conveyor such that the web travels on one or more of the air streams produced by the air conveyor.

15. The process according to claim 1 wherein the web handling system further comprises a tension measuring roller over which the web travels within the web handling system.

16. The process according to claim 1 wherein the web handling system further comprises a driven roll over which the web travels.

17. The process according to claim 1 wherein the web at the time of introduction into the web winding component exhibits a cross machine direction width of greater than 10 inches.

18. The process according to claim 1 wherein the process comprises operating the web winding component such that when the first wound web roll exhibits a diameter of at least 3 inches the first wound web roll exits the web winding component.

19. The process according to claim 18 wherein as the first wound web roll exits the web winding component the core feeder feeds a second core into the operating web winding component.

20. The process according to claim 1 wherein the web handling system further comprises one or more rolls that are repositioned within the web handling system after the web begins winding about the first core.

21. The process according to claim 1 wherein the web handling system further comprises one or more rolls that are repositioned within the web handling system from a threading position to a running position after the web begins winding about the first core.

22. A process for initiating a web winding process after a stop, the process comprising the steps of:

a. providing a web handling system comprising a web winder having a web path, a web winding component, a one or more rolls, and a core feeder, wherein the web winding component is capable of winding a web about a core that it receives from the core feeder;

b. initiating operation of the web winding component after a stop and before introducing the web into the web winding component;

c. operating air sources within the web handling system to progress the web through the web handling system towards the web winding component;

d. operating a web diverter within the web handling system to divert the web from a first web path to a second web path leading to the web winding component;

e. introducing the web through the web path via web guides and air streams into the operating web winding component;

f. initiating operation of the core feeder such that a first core is fed from the core feeder to the operating web winding component after operation of the web winding component has been initiated and concurrent with introducing the web through the web path;

g. initiating loading of a perforating component such that it begins perforating the web; and h. winding the web about the first core to form a first wound web roll.

23. The process according to claim 22 wherein the process further comprises the step of: repositioning one or more of the rolls and web guides within the web handling system from a threading position to a running position after the web begins winding about the first core.

24. The process according to claim 22 wherein the process further comprises the step of: repositioning one or more of the rolls within the web handling system after the web begins winding about the first core.

* * * * *